United States Patent [19]

Kealey et al.

[11] Patent Number: 4,989,518

[45] Date of Patent: Feb. 5, 1991

[54] RAMP SYSTEM FOR ASSEMBLING AND DISASSEMBLING HIGHWAY TRAILERS AND RAILTRUCKS FOR INTERMODAL TRANSPORTATION

[75] Inventors: Thomas F. Kealey, Chicago, Ill.; Harry O. Wicks, El Paso, Tex.; Gary D. Christen, Merrillville, Ind.; Richard L. Jones, Bloomingdale; Kenneth E. Combs, Homewood, both of Ill.

[73] Assignee: The Chamberlain Group, Inc., Elmhurst, Ill.

[21] Appl. No.: 362,752

[22] Filed: Jun. 7, 1989

[51] Int. Cl.[5] ..... B61D 3/18

[52] U.S. Cl. ..... 105/4.3; 105/436; 410/53

[58] Field of Search ..... 105/4.1, 4.3, 436, 458; 410/53; 414/333, 373, 389, 401, 402; 14/69.5; 104/29, 32.1

[56] References Cited

U.S. PATENT DOCUMENTS

| | | | |
|---|---|---|---|
| 662,906 | 12/1900 | Baptist | 414/37 |
| 1,254,352 | 1/1918 | Preifert et al. | 254/88 |
| 1,308,764 | 7/1919 | Olds | 254/45 |
| 1,495,339 | 5/1924 | Maher | 414/572 |
| 1,499,971 | 7/1924 | Callison | 414/337 |
| 1,612,401 | 12/1926 | Townsend | 254/45 |
| 1,785,168 | 12/1930 | Young | 254/45 |
| 1,786,463 | 12/1930 | Thomas | 105/159 |
| 1,994,815 | 3/1935 | Ferrin | 105/215.2 |
| 2,638,852 | 5/1953 | Bannen | 410/53 |
| 2,963,986 | 12/1960 | Dobson | 410/53 |
| 4,190,393 | 2/1980 | Landow | 105/436 |

FOREIGN PATENT DOCUMENTS 0241099 10/1987 European Pat. Off. .

*Primary Examiner*—Matthew C. Graham

*Attorney, Agent, or Firm*—Neuman, Williams, Anderson & Olson

[57] ABSTRACT

A novel ramp system is provided for use in the assembly and disassembly of intermodal highway trailers and intermodal railtrucks for intermodal transportation. The ramp system has an ascending portion for raising the level of the trailer frame onto an elevated portion of the ramp so as to align the respective coupling members in proper relationship for coupling. The ramp system also has a descending portion for transferring the load from the highway wheel assembly of the trailer to the railtruck. The descending portion of the ramp includes a wheel stop to locate the railtruck in an operative location for coupling beneath the trailer during lowering of the trailer frame on top of the railtruck adapter.

22 Claims, 6 Drawing Sheets

FIG. 1
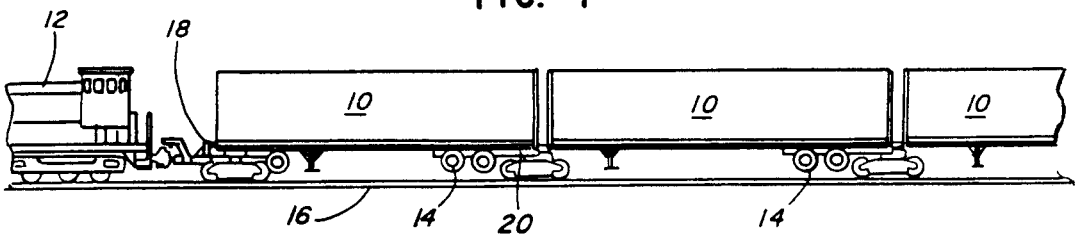
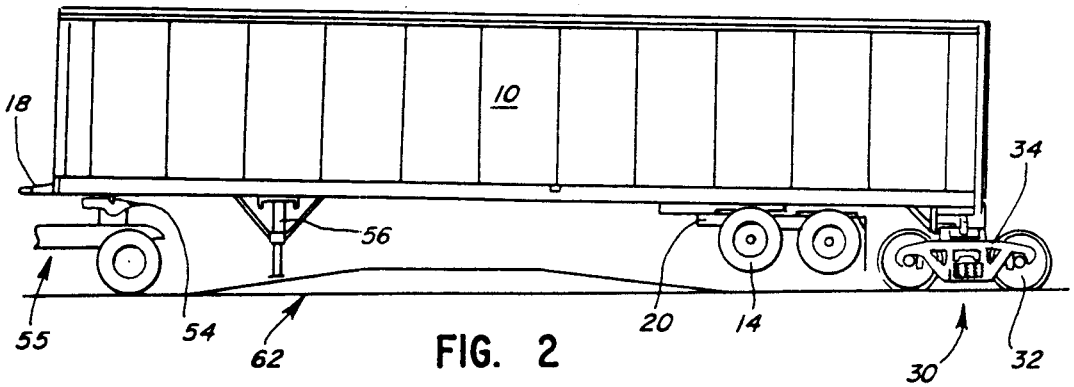
FIG. 2
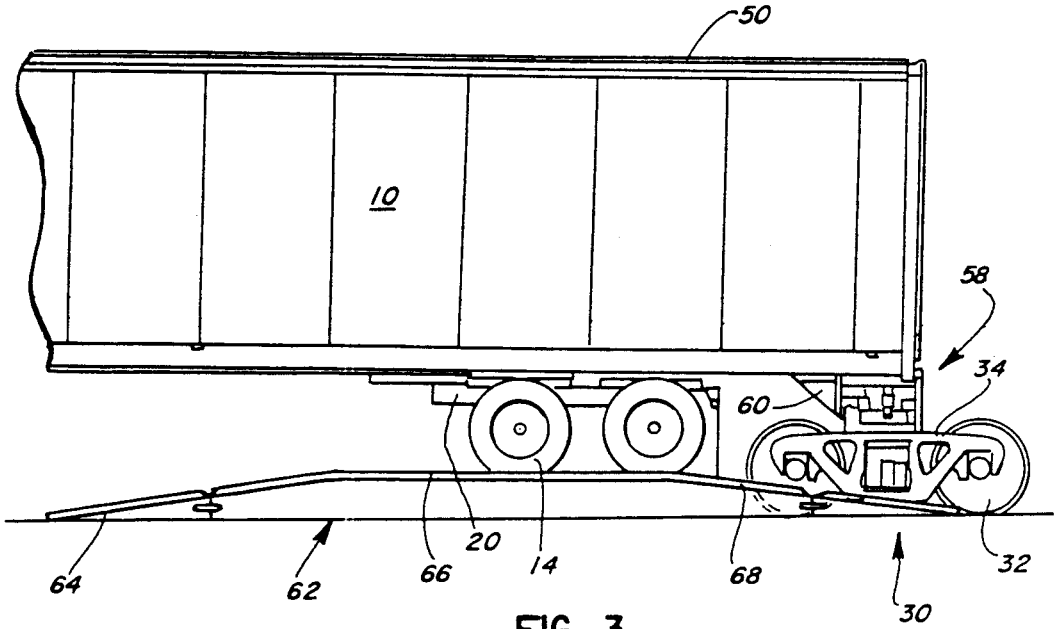
FIG. 3

FIG. 10
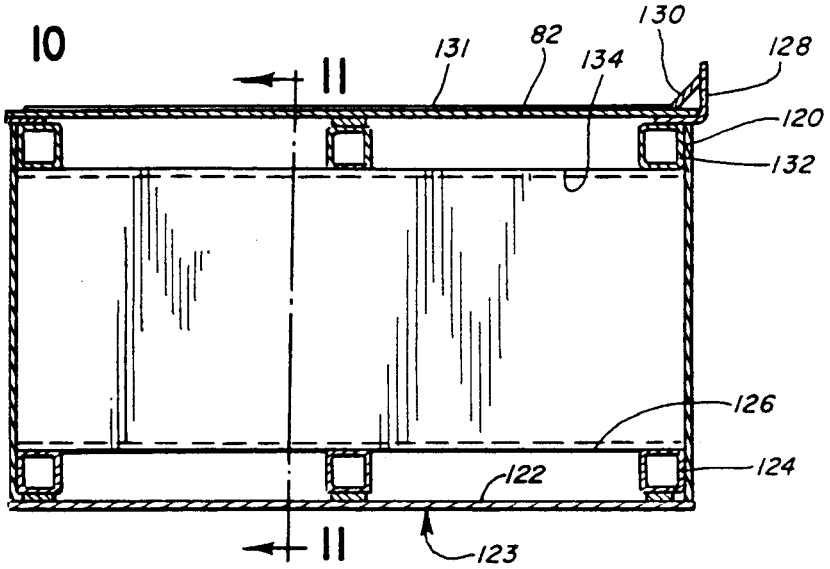
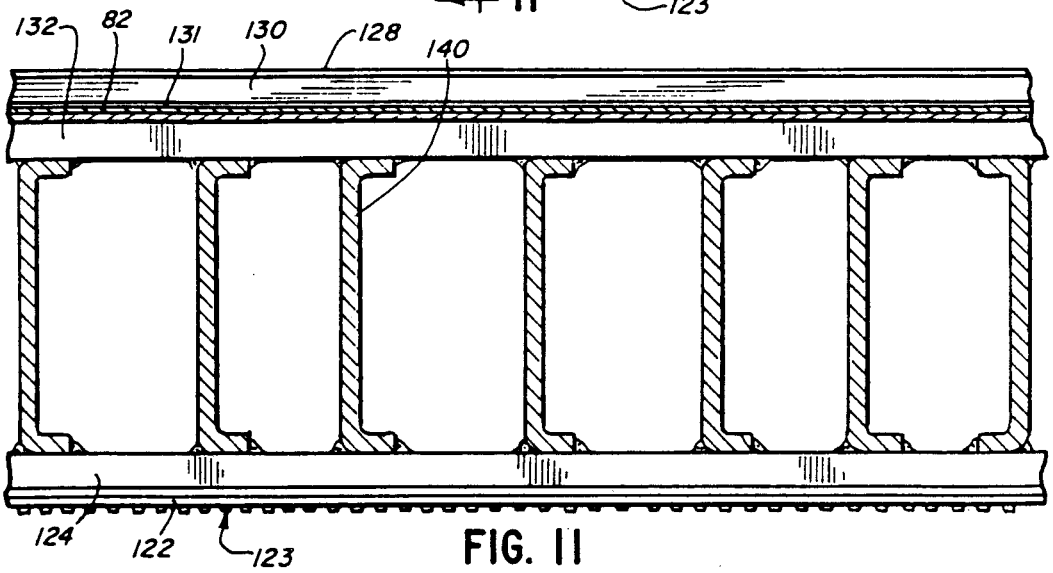
FIG. 11
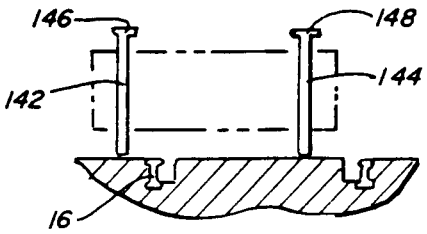
FIG. 12
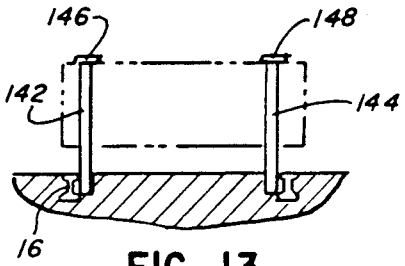
FIG. 13

RAMP SYSTEM FOR ASSEMBLING AND DISASSEMBLING HIGHWAY TRAILERS AND RAILTRUCKS FOR INTERMODAL TRANSPORTATION

BACKGROUND OF THE INVENTION

1. Field of the Invention

The present invention relates to railroad trains formed of intermodal over-the-highway trailers coupled together. More particularly, this invention relates to a novel, low-cost ramp system for raising and lowering intermodal highway trailers to facilitate assembly with or disassembly from railtrucks for intermodal transportation, which system may be portable and is not necessarily limited to highway trailers having a particular wheel suspension system.

2. Description of the Prior Art

A variety of types of intermodal transportation have been developed which utilize a train of highway trailers to travel along railroad track. Such systems attempt to utilize the flexibility and efficiency of highway trailers or semi-trailers for short hauling of units and yet achieve the fuel, labor and equipment cost advantages of railroads for long hauls.

For many decades, the railroad industry has attempted to create an intermodal alternative to the truck which could harness these economies by piggy-backing one mode on top of the other. The typical system of placing highway trailers on railroad flatcars, however, has cost penalties much greater than the economies of truck transportation alone. These disadvantages have led to the development of alternative intermodal systems.

One intermodal system which was developed to attempt to combine the capabilities of rail and highway in one vehicle is set forth in U.S. Pat. No. 4,202,277 to Browne et al. This system includes a highway trailer that may be operated over the highway as a truck trailer and over the railroad in unit trains. The trailer body has both highway and rail running gear, both supported by an air suspension system, and is independently supported upon the highway running gear for highway operation, and upon the railroad railtruck bogies for railroad operation. The air spring suspension allows the independent raising and lowering of the highway running gear and the railroad bogie for selective use in the railroad mode or the highway mode. The semi-trailers are couplable end-to-end to form a train of multiple semi-trailers in the railroad mode of travel.

Another approach to intermodal systems is set forth in U.S. Pat. No. 4,669,391 to Wicks et al., which is incorporated herein by reference. This system includes a highway trailer which is mounted on a conventional railtruck with an intermodal adapter. In order to couple the trailer to the railtruck, the trailer is backed up to the railtruck bogie and the air suspension is inflated to lift the trailer body a few inches. Further backing of the trailer allows mounting onto the bogie. Once mounted, lock pins secure the trailer body and coupling saddle into a unitized rail platform. The air suspension air bags are then deflated and coil springs lift the highway trailer tires to clear the rail.

While both of the above systems are commercially successful systems, both require the utilization of air spring suspension systems. The commercial embodiment of the Browne et al. system utilizes the air spring suspension system to raise and lower the highway running gear and the railroad bogie. The commercial embodiment of the Wicks et al. system utilizes the air spring suspension system, or an alternate hydraulic system, to raise the trailer the appropriate distance to allow mounting onto the bogie.

As a result of the high cost and limited availability of intermodal highway trailers with air spring suspension systems, there is a need for a trailer-bogie mounting system which is able to accommodate both air spring and standard spring suspension intermodal trailers and yet utilize the available commercial railtruck units. Such a mounting system would allow utilization of intermodal systems without the need for a costly air spring suspension system.

Other prior art systems, such as the one shown in U.S. Pat. No. 2,963,986 to Dobson, which have attempted to depress the track in order to raise the level of the trailer with respect to the rail bogie, fail to provide the necessary portability for versatility and to allow other uses of the railtrack when not used to assemble intermodal systems. These prior art systems are also not usable with certain commercially-available intermodal system trailers and railtrucks.

Accordingly, a need exists for a system for connection of intermodal highway trailers to, and disconnection of intermodal highway trailers from, railtrucks for intermodal transportation, which system may be portable and not limited to a particular type of trailer suspension system, but may in fact be utilized with conventional, lower cost spring suspension intermodal trailers and existing intermodal railtrucks.

OBJECTS OF THE INVENTION

It is therefore a general object of this invention to provide a system for assembling and disassembling intermodal highway trailers and railtrucks for intermodal transportation which meets the aforenoted needs.

It is another general object to provide a lowcost system for assembling and disassembling intermodal trains which has a far greater universality of application, both as to equipment and location, than other systems heretofore available.

It is a specific object of this invention to provide a system for connection of intermodal highway trailers to railtrucks for intermodal transportation which avoids the disadvantages and complexities associated with air suspension systems.

It is a further object to provide a system for connection of highway trailers to railtrucks for intermodal transportation which accommodates an intermodal highway trailer having a conventional spring suspension.

It is another object to provide a system for connection of intermodal highway trailers to railtrucks for intermodal transportation which utilizes a ramp apparatus for raising and lowering of the highway trailer to allow coupling to and uncoupling from the railtruck.

It is still another object to provide a system for assembling and disassembling intermodal trailers and railtrucks which is not limited to a particular type of trailer suspension and is portable so as not to be limited to a fixed location.

Other objects, advantages and features of the present invention will become apparent upon reading the following detailed description and appended claims, and upon reference to the accompanying drawings.

SUMMARY OF THE INVENTION

In accordance with one embodiment of this invention, a novel ramp system is provided for use in the assembly and disassembly of intermodal highway trailers and railtrucks for intermodal transportation. The ramp system is utilized in conjunction with a highway trailer having a main frame or unibody or the like and at least one highway wheel assembly, which trailer is to be mounted on or dismounted from a railtruck having a pair of side frames and a bolster supported on the side frames for limited rocking movement.

Typically, the railtruck comprises an intermodal system rail bogie of conventional design, on the bolster of which is mounted an adapter to adapt it to intermodal service. The highway trailer has a first coupling means adjacent the lower rear of the trailer and the railtruck has a second coupling means which is usually part of the adapter and is supported by the railtruck. The second coupling means and first coupling means are designed to releasably lock the highway trailer to the railtruck.

The ramp system has an ascending portion for raising the level of the trailer frame into a raised position on an elevated portion of the ramp so as to align the respective coupling means in proper relationship for coupling. The ramp system also has a descending portion for transferring the load from the highway wheel assembly to the railtruck, such transfer lowering the level of the trailer frame slightly into an operative position on top of the railtruck adapter. The lengths of the ascending and descending portions are each substantially greater than the height of the elevated portion, as will be apparent from the drawings.

The descending portion of the ramp includes a wheel stop to locate the railtruck in an operative location beneath the trailer for coupling during lowering of the trailer frame on top of the railtruck adapter and transfer of the load thereto. Prior to ascending the ramp and the lowering of the trailer, the trailer wheel assembly is moved forward along the underbody of the trailer and locked to the trailer in the forward position so as to provide clearance for the railtruck. As the trailer travels towards and down the descending portion of the ramp, a transverse bar on the trailer contacts the railtruck so that both move in unison and in correct alignment for coupling and load transfer.

The ramp system comprises interconnected but spaced-apart and aligned left-hand and right-hand ramps or ramp portions which support the wheel assemblies of the trailer and allow the railtrack to fit between. Guide members are provided on the ramp to direct and guide the trailer wheels onto the ramp. The right-hand and left-hand portions of the ramp are constructed of flat, rigid members of sufficient width to support the tires of the trailer wheel assemblies. The ramp itself may have a wheel assembly to permit mobility. The ramp may also include indicator means in the form of movable flat bars extending from the surface of the elevated portion of the ramp to a point beneath the level of the railtrack to indicate proper positioning of the ramp with respect to the track and to stabilize it laterally.

BRIEF DESCRIPTION OF THE DRAWINGS

For a more complete understanding of this invention, reference is herewith made to the preferred embodiment illustrated in greater detail in the accompanying drawings and described below by way of an example of the invention. In the drawings:

FIG. 1 is a diagrammatic view of a railway train comprising a locomotive and a plurality of intermodal highway trailers interconnected and carried upon railtrucks;

FIG. 2 is a side elevation view of a trailer coupled to a railtruck by means of the ramp system of the present invention;

FIG. 3 is a side elevation view of a portion of a trailer atop the elevated portion of the ramp apparatus of the present invention prior to coupling with the adapter portion of the railtruck;

FIG. 10 is a sectional view taken along line 10—10 of FIG. 7;

FIG. 11 is a sectional view taken along line 11—11 of FIG. 10;

FIG. 12 is a sectional view illustrating the indicator means of the ramp apparatus above the railtrack and prior to proper alignment;

FIG. 13 is a sectional view illustrating the indicator means of the ramp apparatus properly aligned and in the spacing alongside the railtrack;

DETAILED DESCRIPTION OF THE DRAWINGS

Figure 4:
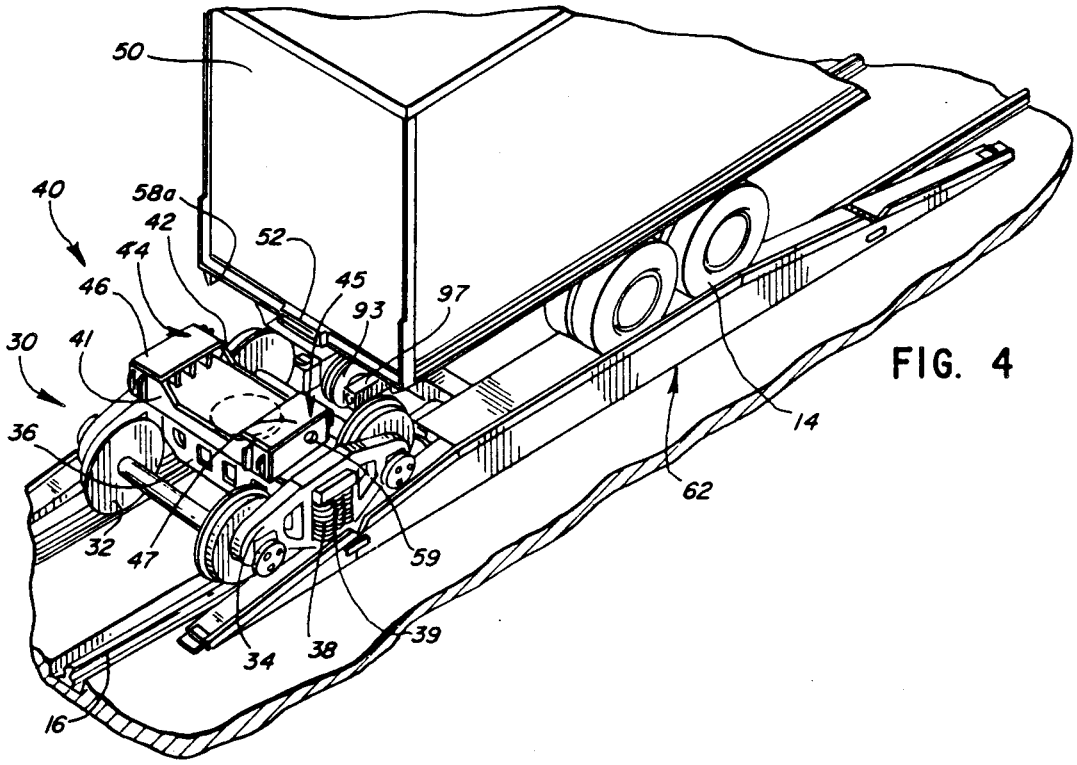
FIG. 4 is a perspective view of the trailer atop the ramp apparatus in a position prior to coupling to the adapter of the railtruck bogie.

Turning now to the drawings, FIG. 1 illustrates a railway train comprising a plurality of intermodal system highway trailers interconnected together and coupled to railtruck bogies. The highway trailers are indicated generally at 10 and are pulled by a locomotive 12. When the trailers are interconnected, the trailer wheel assemblies 14 are supported above the track or rail 16. The trailers are designed for use in a unit train where all of the trailers have a similar chassis and coupling structure.

The trailers in the train are modified highway trailers, which are carried by adapters on standard type railtrucks equipped with standard railway type air brakes. At the front end of the trailer is a tongue 18 which is secured to the trailer in a load carrying relationship.

When a trailer is carried over the highway or around the railyard, the front end is carried by the fifth wheel of a truck tractor or railyard hostler. At the back end of the trailer, the wheel assemblies 14 may be mounted on a subframe 20. The wheel assemblies are kept in sliding engagement along the subframe 20 to allow movement between multiple positions. The wheel assemblies are typically in the rearward position for highway travel and in the forward position for rail travel. The wheel assemblies may be supported by a standard leaf spring suspension. As a result of the ramp system described below, an air suspension system is not necessary to raise the trailer with respect to the wheels in order to mount the trailer on the bogie.

Figure 5:
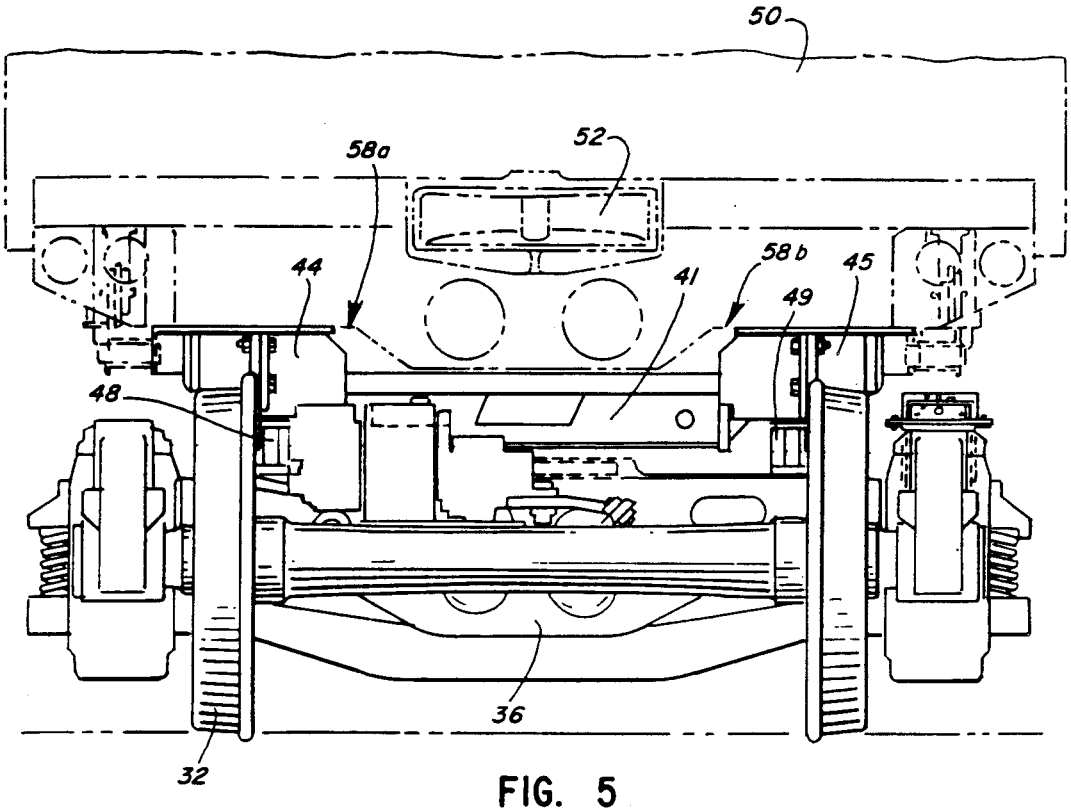
FIG. 5 is a rear elevation view of the trailer atop the adapter portion of the railtruck bogie.

In FIG. 2, the trailer is shown coupled to the railtruck bogie. The railtruck 30 includes wheels 32 and side frame 34. The railtruck is shown in more detail in FIGS. 4 and 5. The truck includes a bolster 36 which extends between the side frames. The bolster 36 is of generally box-shaped construction at each end. Compression members or coil springs 38, 39, contained within a spring nest, help support the bolster.

The adapter 40 for the intermodal system is located on the top of bolster. A pair of flat parallel plates 41, 42 extend along the adapter. At the ends of the plates are a pair of spaced apart top portions 44, 45. The top portions 44, 45 form the coupling portion of the railtruck. The top portions are typically box-like and formed of a series of flat plates, such as top plates 46, 47. The top portions rest on a plurality of compressible members, including bearings 48, 49.

The trailer 10 includes a body 50 of conventional over-the-highway semi-trailer dimensions. The body 50 has a male coupling member or tongue 18 at its front end and a female coupling member 52 at its rear end to receive the male member of an adjacent body. Each trailer includes a conventional kingpin 54 adjacent its front end for removable coupling to the fifth wheel of a tractor, for highway transportation, or hostler 55 for railyard transportation. The trailer also includes conventionally placed telescoping landing gear 56.

The bottom of the trailer includes a coupling means 58 which is an integral and permanent part of the trailer body. The coupling member is capable of detachably coupling with the top portions of the railtruck adapter. The trailer coupling means may be a pair of socket-like members **58*a*, 58*b*, to receive the box-like top portions 44, 45 of the railtruck adapter. A releasable locking means, or pin (not shown), extends through an aperture 59 in the railtruck end portions and an aperture (not shown) in the trailer coupling member 58. The bottom of the trailer also includes a rigid bar 60**, commercially known as an I.C.C. bar, which extends at least partially across the width of the trailer.

Figure 6:
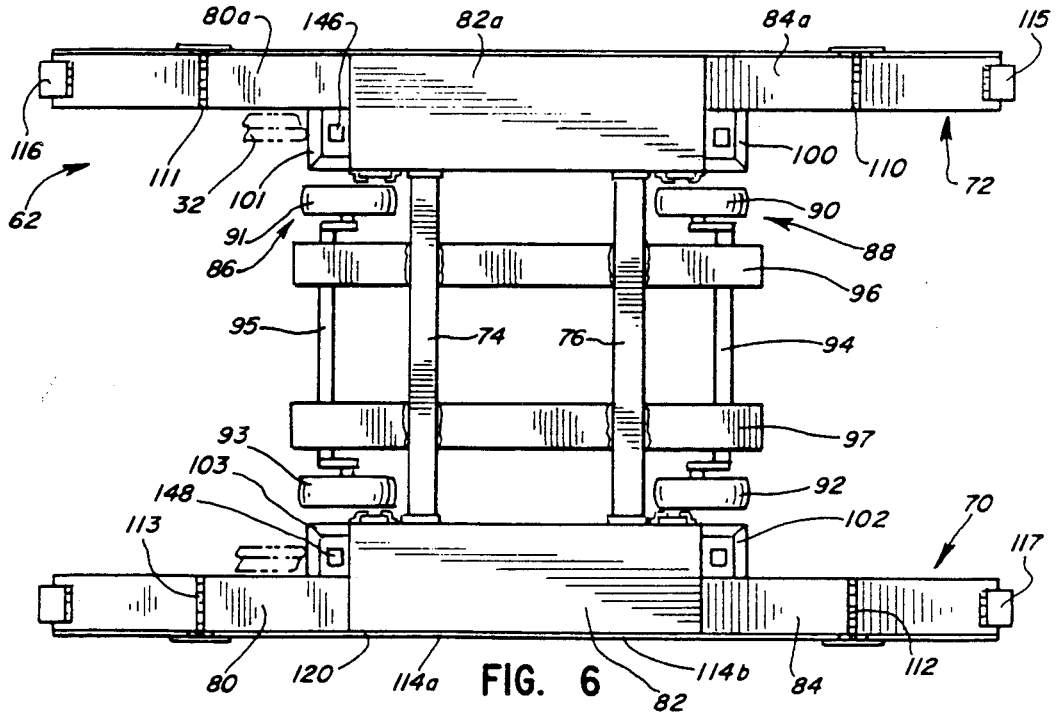
FIG. 6 is a top plan view of the ramp apparatus of the present invention showing the right-hand and left-hand portions of the ramp and the wheels of the railtruck in phantom against the wheel stops.
Figure 7:
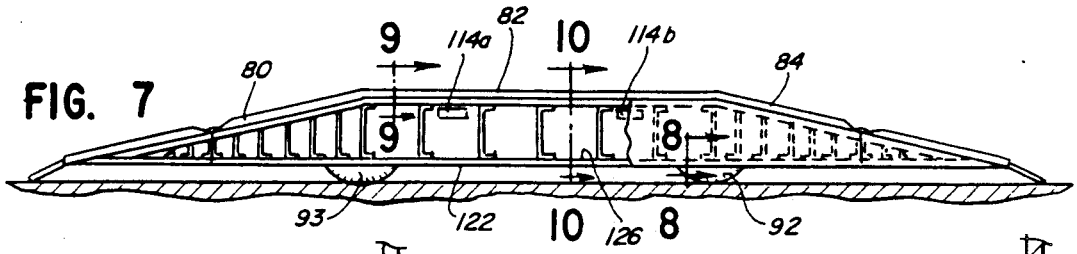
FIG. 7 is a side elevation view of the ramp apparatus of FIG. 6, partially broken away to show the internal construction.

The ramp system of the present invention is shown generally at 62 in FIGS. 2, 3 and 6, and in detail in FIGS. 7–13. As seen in FIG. 3, the ramp 62 includes an ascending portion 64, a flat elevated portion 66 and a descending portion 68. The ascending portion 64 is preferably of the same length as the descending portion 68 which allows each of the aforesaid portions to be reversible with one another.

The elevated portion is preferably at a height above the ground which is substantially less than the length of the ascending portion. This allows clearance of the landing gear 56 over the ramp as the trailer ascends the ramp. Preferably the angle formed between the ascending portion and the horizontal is on the order of seven degrees.

The ramp is formed of symmetrical right-hand portion 70 and left-hand portion 72, which are separated by ramp spreaders 74, 76. The ramp spreaders may include hydraulically or pneumatically actuated inserts (not shown) which allow the lateral movement of the right-hand and left-hand portions away from one another. The ramp spreaders 74, 76 are of sufficient length to spread the ramp portions to allow the passage of railtrack between the portions. The spreaders are preferably of a length sufficient to allow support of the right side and left side trailer wheel assemblies on the ramp portions.

The ramp portions of the right-hand portion 70 are formed of flat, rigid members 80, 82, 84. Left-hand portion 72 has corresponding flat, rigid members **80*a*, 82*a*, 84*a*. As seen more clearly in FIG. 6, the flat members 80, 84 of the ascending portion 64 and descending portion 68 are of sufficient width to support one wheel of the wheel assembly. The flat member 82** of the elevated portion is of sufficient width to support two tires of the wheel assembly.

Mobility of the ramp 62 is achieved by ramp wheel assemblies 86, 88. The wheel assemblies 86, 88, include wheels 90, 91, 92, 93 and ramp axles 94, 95 positioned between the wheels. The ramp axles 94, 95 are spring loaded to allow the ramp to move vertically downward over the wheels when the weight of the trailer is on top of the ramp. Longitudinal members 96, 97 are also included for structural support of the wheel assemblies. The portability of the ramp afforded by the wheel assembly system allows movement of the ramp away from the railtrack when not in use for assembly of intermodal systems.

For proper positioning of the railtruck with respect to the trailer, wheel stops 100, 101, 102, 103 are provided at four locations on the inside of the ramp portions. As shown in FIG. 3, the generally precise positioning of the railtruck is necessary in order to assure proper coupling of the trailer to the railtruck. In the preferred embodiment, with the seven degree angle of elevation of the ascending portion with respect to the ground, the wheel stop is located thirty-three (33) inches from the edge of the elevated portion of the ramp. This positioning allows the transverse rigid bar 60, or the like, to contact the railtruck and begin motion of the railtruck as the trailer wheel assemblies 14 begin to travel the descending portion 84 of the ramp. Each of the ascending, elevated and descending portions of the ramp preferably extend 114 inches in length as measured along the horizontal.

To assist the mobility of the ramp unit, hinges 110, 111, 112, 113 are provided on the ascending and descending portions of the ramp. The hinges permit the folding of the unit to an upward position to allow transportation of the unit around the railyard. To transport the unit, the ramp may be pulled by a hostler 55 or may be lifted by a forklift truck or other suitable means. For this purpose, forklift pockets **114*a*, 114*b*** are provided.

Four engagement plates 115, 116, 117, 118 are provided at the ends of each ramp portion in order to assist the backing of the trailer onto the ramp. The plates are each hinged to the ramp. The engagement plates act to assure contact of the ramp with the ground before the weight of the trailer forces the ramp into ground contact.

Figure 8:
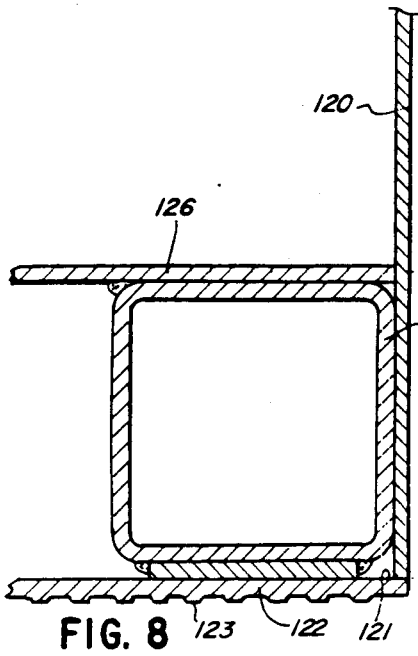
FIG. 8 is a sectional view taken along line 8—8 of FIG. 7.

The details of the construction of the ramp are shown more clearly in FIGS. 7–13. In FIG. 8, the bottom portion of the ramp is shown in detail. A ramp side plate 120 is shown welded at weld 121 to a bottom plate 122. Treads 123 are placed on the underside of the bottom plate 122 to assist holding of the ramp in position against the ground. Tubing 124 is interposed between bottom plate 122 and bottom cross plate 126 for structural support. The plates and tubing are secured by any suitable means, such as welding.

Figure 9:
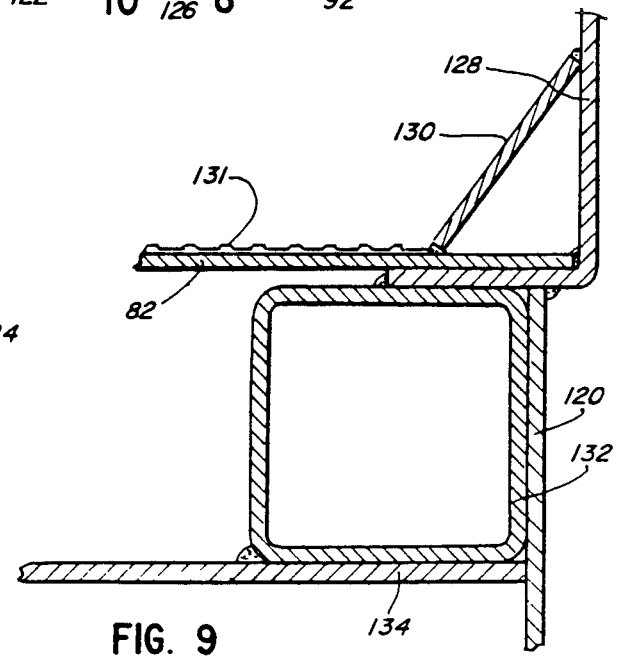
FIG. 9 is a sectional view taken along line 9—9 of FIG. 7.

In FIG. 9, the upper portion of the ramp is shown in detail. The ramp side plate 120 is shown connected to the flat, rigid member 82 by L-shape bracket 128. The L-shape bracket 128 provides support for the wheel guide member 130. The angle of the wheel guide member acts in the same manner as highway median barrier wall to direct the wheels of the trailer to the center of the ramp. As shown in FIG. 10, the wheel guide members are preferably only on the outside of the ramp portion. Treads 131 are applied to the upper surface of the rigid member 82 to aid traction of the hostler wheels. Tubing 132 is interposed between the L-shaped bracket 128 and the upper cross plate 134 for structural support. As in the bottom portion of the ramp, the plates and tubing are secured by any suitable means, such as welding.

In FIGS. 10 and 11, the cross-section of the ramp is shown in greater detail. The tubing 124 and 132 is shown supporting both the center and the sides of the ramp portion at the top and the bottom. C-shaped support members 140 also provide structural support between the top and the bottom of the ramp.

In FIGS. 12 and 13, the details of rail indicator system are shown. The rail indicators are in the form of flat bars 142, 144 having sufficient length to extend from the surface of the elevated portion of the ramp to a point beneath the rail track 16. The tops 146, 148 of the indicators are shown in FIG. 6. The rail indicators may be spring loaded (not shown) and have rounded bottoms. The rail indicators slip into the spacing next to the rail track, as shown in FIG. 13, when the ramp is properly positioned over the rail. The indicators also provide a means of retaining the ramp in a fixed position with respect to the rail during the trailer-bogie coupling operation.

Figure 14:
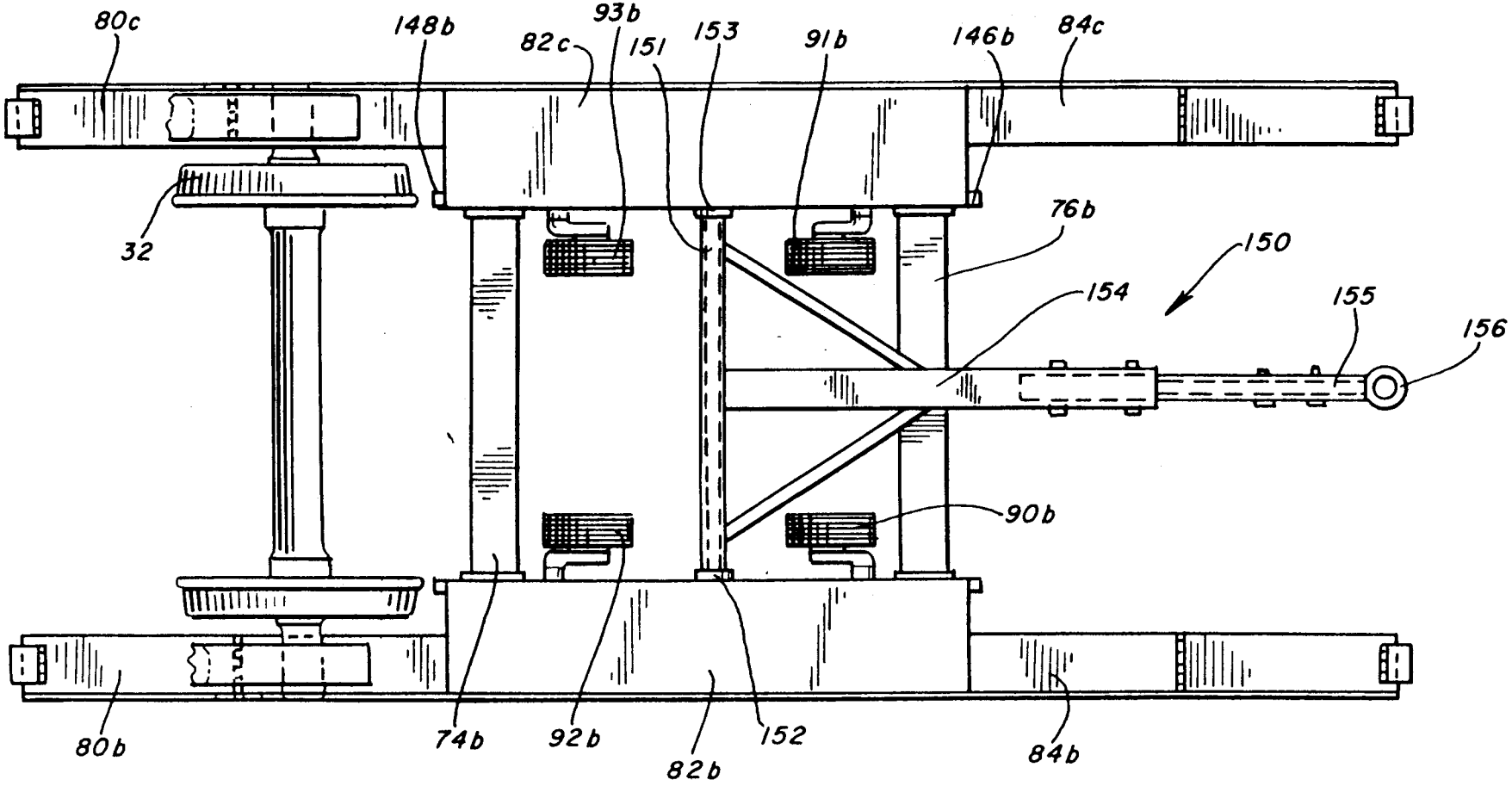
FIG. 14 is a top plan view of an alternate embodiment of the ramp apparatus of the present invention showing wheels of the railtruck; and, FIG. 15 is a schematic illustrating the spring and cable wheel assembly retention system of the present invention.

An alternate embodiment of the ramp system is shown in FIG. 14. The ramp includes flat, rigid members along the ascending portions **80*b*, 80*c*, elevated portions 82*b*, 82*c*, and descending portions 84*b*, 84*c*. The ramp is similar in structure to the embodiment of FIG. 6, and includes the structure previously described, with several significant differences. The ramp spreaders 74*b*, 76*b*, have been moved outboard of the wheels 90*b*, 91*b*, 92*b*, 93*b*. The longitudinal members 96, 97, shown in the FIG. 6** embodiment, have been eliminated.

Similarly, the wheel stop members 100, 101, 102, 103, shown in FIG. 6, have been eliminated. The location of the railtruck with respect to the trailer for coupling is determined by an interference of the railtruck sideframe with the descending portion of the ramp. The railtruck is moved as close as possible to the trailer and is in the proper position for coupling once the bottom portion of the side frame interferes with the ramp. Thus, the interference condition between the ramp and the railtruck serves as the wheel stop means. With the elimination of the wheel stop members, the rail indicators **146*b*, 148*b*** are moved to the outside of the elevated portions.

The embodiment of FIG. 14 also includes a tow bar 150, which may be used with the embodiment of FIG. 6. The tow bar 150 includes a base member 151 which is hingedly connected to the ramp at side connections 152, 153. The bar itself includes outside member 154 and inside member 155, with the inside member telescoped within the outside member. A tow hook 156 is provided at the end of the inside member for connection to a hostler or other tractor for transport around the railyard.

For use in conjunction with the ramp system, the present invention provides a trailer suspension system which retains the wheel assembly against the trailer. The preferred embodiment includes a limited free-play suspension system which is commercially available from Hutchens Company or similar suspension manufacturers. The limited free-play suspension system uses steel bushings and limits the downward movement of the suspension system. This retains the wheel assembly against the trailer during the rail mode operation.

Figure 15:
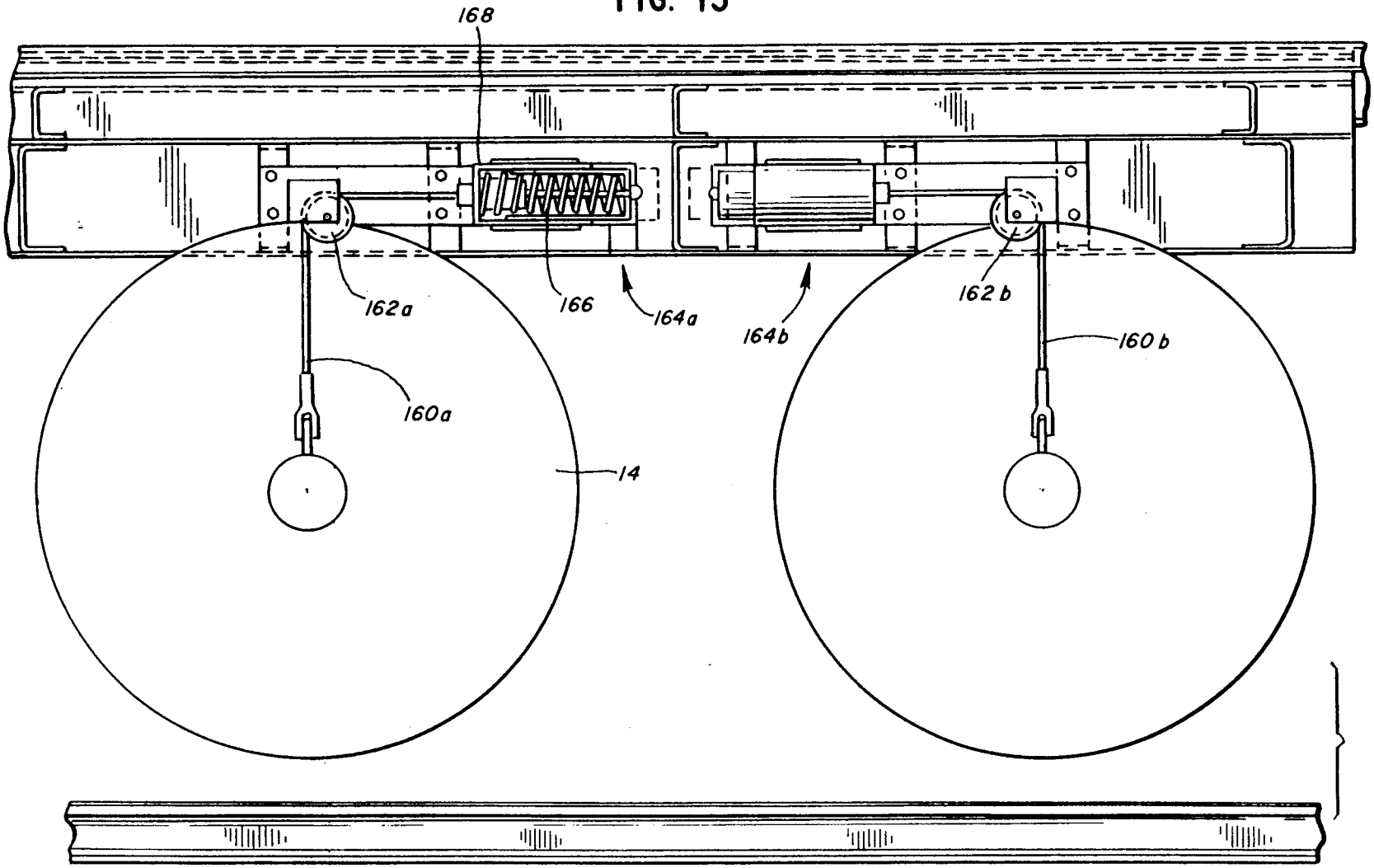

An alternative embodiment of the wheel assembly retention system is set forth in FIG. 15. The wheel assembly 14 is shown attached at a first end to cables **160*a*, 160*b*. The cables are wrapped around sheaves 162*a*, 162*b* and have their other ends attached to spring devices 164*a*, 164*b*. Each spring device includes a standard coil spring 166 set within an enclosure 168**. The spring device is secured to the suspension frame or the like. When the wheel assembly is raised off of the ground, as in the rail mode, the springs act to pull the cables and raise the wheels off of the ground and retain the wheel assembly against the trailer.

Other alternative embodiments of the wheel assembly retention system would include, for example, the use of a sliding bar along the frame of the trailer. A plurality of hook assemblies would be included on the bar which would act to hold the wheel assembly in a raised position while in the rail mode.

In operation, the ramp system acts to raise the level of the trailer to allow coupling of the trailer to the railtruck bogie for assembly of the intermodal system. The ramp is placed in position along the railtrack. The ramp may be moved by the hostler or a fork lift truck. The ramp is placed across the railtrack so that the width of the ramp spans the track. The ramp indicator means assist in determining when the ramp is in the proper position.

Once the ramp is in position along the track, the ascending and descending portions are lowered over hinges 110, 111, 112, 113 and the engagement plates are lowered into position. With the ramp in position, the railtruck is moved into position against the wheel stops or against the descending portion of the ramp.

The trailer is then moved by the hostler around the railyard and backed into position at the front of the ramp ascending portion. The trailer is then backed up the ascending portion of the ramp onto the elevated portion. Only the outside wheels of the trailer contact the ascending portion of the ramp as the trailer ascends the ramp. Once on the elevated portion of the ramp, both outside and inside wheels of the trailer are supported by the ramp. As the trailer ascends the ramp, the weight of the trailer forces the bottom plate 122 of the ramp into contact with the ground. Guide means on the ramp direct the wheels of the trailer to the center and keep the wheels on the ramp.

To couple the trailer with the railtruck, the trailer is backed further over the ramp and down the descending portion of the ramp. As the trailer begins its descent down the descending portion of the ramp, the transverse rigid bar or a similar member contacts the railbogie and starts the railtruck moving in the same direction as the trailer. In the preferred embodiment, the transverse bar begins to contact the railtruck as the center of the wheel assembly begins to travel down the descending portion. During this movement, the trailer couples with the bogie by the interconnection of the two previously-described coupling portions.

Decoupling of the trailer and railtruck is preferably accomplished in the following manner. The train of trailers is first pulled to a location for decoupling. The landing gear on the foremost trailer is lowered to the ground and the locomotive and coupler is then decoupled and driven away. The ramp system assembly is then positioned on the track ahead of the wheel assembly of the first trailer. The hostler tractor is attached to the first trailer by the fifth wheel of the hostler. The landing gear on the next trailer is then lowered to the ground.

The first trailer is then decoupled from the second trailer by release of the coupling pins and the first trailer is pulled by the hostler tractor up the ramp. The hostler must traverse the ramp followed by the trailer. The trailer, when pulled forward, can thus be decoupled from the railtruck in the previously described manner. The trailer is then free from the railtruck bogie and each can be used in separate operations.

Thus, a ramp system for coupling a trailer to a railtruck has been provided which meets the aforestated objects. The ramp is portable and provides both an ascending portion and a descending portion which eliminates the need for an air suspension in the trailer to raise the level of the trailer for coupling to the railtruck. The ramp has wheel stops in order to allow precise location of the railtruck with respect to the trailer to allow proper coupling.

While one preferred embodiment of the invention is illustrated, it will be understood that the invention is not limited to this embodiment. Those skilled in the art to which the invention pertains may make modifications and other embodiments employing the principles of this invention, particularly upon considering the foregoing teachings. Such modifications and other embodiments are considered within the spirit and scope of the present invention.

What is claimed is:

1. A system for connection of highway trailers to railtrucks for intermodal transportation, said system comprising:

a highway trailer including a main frame and at least one highway wheel assembly; said highway trailer having a first coupling means adjacent the lower rear thereof;

a railtruck having a pair of side frames and a bolster supported on said side frames; said railtruck having a second coupling means supported thereby, said second coupling means and said first coupling means being selectively matable and releasable; and, ramp means having an ascending portion for raising the level of said trailer frame into a raised position above said railtruck and a descending portion for lowering the level of said trailer frame into an operative position on top of said railtruck.

2. The system of claim 1 wherein the length of said ascending portion is substantially greater than the height of said raised position.

3. The system of claim 2 wherein the length of said ascending portion is equal to the length of said descending portion.

4. The system of claim 1 wherein said descending portion includes wheel stop means to locate said railtruck in an operative location for coupling beneath said trailer during lowering of said trailer frame on top of said railtruck.

5. The system of claim 4 wherein said wheel stop means is located so as to position a transverse bar on said trailer frame against said railtruck when one of said highway wheel assemblies of said trailer is positioned at the top of said descending portion of said ramp means.

6. The system of claim 4 wherein said wheel stop means comprises an interference condition between the location of said railtruck and said descending portion.

7. The system of claim 6 wherein said transverse bar initiates movement of said railtruck as said wheel assembly traverses said descending portion of said ramp means.

8. The system of claim 1 wherein said ramp means includes an elevated portion between said ascending portion and said descending portion, said elevated portion being of sufficient length to support a plurality of said trailer wheel assemblies.

9. The system of claim 8 wherein said ascending and descending portions include flat, rigid members of sufficient width to support at least one tire of said wheel assemblies; said elevated portion includes a flat, rigid member of sufficient width to support two tires of said wheel assemblies.

10. The system of claim 9 wherein said ascending portion, said elevated portion and said descending portion are divided to define a right-hand portion and a left-hand portion, said right-hand and left-hand portions being sufficiently spaced to allow passage of railtrack therebetween and to support right side and left side trailer wheel assemblies thereon.

11. The system of claim 10 wherein said ramp means includes ramp wheel assemblies located between said right-hand and left-hand portions.

12. A ,ramp apparatus for raising and lowering an intermodal highway trailer onto an intermodal railtrack to allow coupling of said intermodal highway trailer with said intermodal railtruck to allow intermodal transportation, said ramp comprising:

an ascending portion for raising the level of the trailer frame of said intermodal highway trailer into a raised position above said intermodal railtruck; and, a descending portion for lowering the level of said trailer frame into an operative position on top of said intermodal railtruck for selective matable and releasable coupling of said intermodal highway trailer with said intermodal railtruck;

wherein the length of said ascending portion is substantially greater than the height of said raised position and is equal to the length of said descending portion, and wherein said descending portion includes wheel stop means to locate said railtruck in an operative location for coupling beneath said trailer during lowering of said trailer frame on top of said railtruck.

13. The ramp apparatus of claim 12 including an elevated portion; said ascending portion, said elevated portion and said descending portion being divided to define a right-hand portion and a left-hand portion; said right-hand and left-hand portions being sufficiently spaced to allow passage of rail track therebetween and to support right side and left side trailer wheel assemblies thereon.

14. The ramp apparatus of claim 13 wherein said ascending and descending portions include flat, rigid members of sufficient width to support one tire of said wheel assemblies; said elevated portion includes a flat, rigid member of sufficient width to support two tires of said wheel assemblies; said ascending portion, said elevated portion and said descending portion being divided to define a right-hand portion and a left-hand portion, said right-hand and left-hand portions being sufficiently spaced to allow passage of railtrack therebetween and to support right side and left side trailer wheel assemblies thereon.

15. The ramp apparatus of claim 14 wherein said elevated portion includes rail indicator means extending below the surface of said elevated portion.

16. The ramp apparatus of claim 15 wherein said rail indicator means include flat bars having sufficient length to extend from the surface of said elevated portion to a point beneath the level of the rail track.

17. The ramp apparatus of claim 14 wherein an engagement plate is included between each of said flat rigid members and the ground surface.

18. The ramp apparatus of claim 14 wherein said stop means is located to position a transverse bar on said trailer frame against said railtruck bolster when one of said highway wheel assemblies of said trailer is positioned at the top of said descending portion of said ramp means.

19. The ramp apparatus of claim 14 wherein each of said right-hand and left-hand portions include guide means for directing the wheels of said trailer onto said flat rigid member.

20. The ramp apparatus of claim 14 wherein at least one of said right-hand and left-hand portions is operatively connected to tow means for imparting motion to said apparatus.

21. The ramp apparatus of claim 20 wherein said tow means includes a plurality of telescoping members and a tow hook.

22. A method of connection of a highway trailer to a railtruck for intermodal transportation, said highway trailer including a main frame and at least one highway wheel assembly and a first coupling means adjacent the lower rear thereof, said railtruck having a pair of side frames and a bolster supported on said side frames for limited rocking movement and a second coupling means supported thereby, said second coupling means and said first coupling means being selectively matable and releasable, said method comprising the steps of:

placing a ramp means behind said trailer, said ramp means having an ascending portion for raising the level of said trailer frame into a raised position above said railtruck and a descending portion for lowering the level of said trailer frame into an operative position on top of said railtruck;

placing said railtruck in an operative position for coupling adjacent said descending portion of said ramp means;

backing said trailer across said ascending portion of said ramp means; and, continuing to back said trailer across said descending portion of said ramp means to allow coupling of said trailer and said railtruck.

* * * * *